US005609685A

United States Patent [19]

Fux

[11] Patent Number: 5,609,685

[45] Date of Patent: Mar. 11, 1997

[54] APPARATUS SUITABLE FOR PROVIDING DIRECTLY BY MEANS OF CALENDERING AN EXCELLENT ANCHORAGE BETWEEN A FABRIC AND ITS PLASTIC COATING MATERIAL

[75] Inventor: Charly Fux, Cravesano, Switzerland

[73] Assignee: Interplastic SA, Inferiore, Switzerland

[21] Appl. No.: 397,389

[22] Filed: Mar. 2, 1995

[30] Foreign Application Priority Data

Mar. 17, 1994 [IT] Italy ..... MI94A0493

[51] Int. Cl.[6] ..... B05C 1/08; B05C 1/12

[52] U.S. Cl. ..... 118/60; 118/67; 118/117; 118/249; 118/258; 156/437; 156/499

[58] Field of Search ..... 118/33, 34, 66, 118/67, 117, 120, 249, 256, 258, 405; 427/176, 316, 365, 366; 68/22 B; 156/472, 229, 322, 359, 437, 496, 499, 555; 264/175

[56] References Cited

U.S. PATENT DOCUMENTS

| | | | |
|---|---|---|---|
| 776,532 | 12/1904 | Moraud | 118/34 |
| 1,077,126 | 10/1913 | Doughty | 118/34 |
| 1,306,650 | 6/1919 | Weinheim | 427/365 |
| 1,465,092 | 8/1923 | Respess | 427/365 |
| 1,468,351 | 9/1923 | Ayres | 427/365 |
| 1,763,363 | 6/1930 | Moller | 118/120 |
| 1,826,697 | 10/1931 | Carch et al. | 118/66 |
| 1,967,529 | 7/1934 | Grower | 427/176 |
| 3,294,613 | 12/1966 | Eichler et al. . | |
| 3,694,927 | 10/1972 | Sorenson | 118/60 |
| 4,052,521 | 10/1977 | Ferrari . | |
| 4,071,392 | 1/1978 | Chaudhuri | 156/359 |
| 4,383,882 | 5/1983 | Held | 156/555 |
| 4,388,364 | 6/1983 | Sanders . | |
| 4,861,409 | 8/1989 | Hashida et al. | 156/555 |
| 5,033,373 | 7/1991 | Brendel et al. | 118/60 |
| 5,389,183 | 2/1995 | Seki et al. | 156/472 |

FOREIGN PATENT DOCUMENTS

| | | |
|---|---|---|
| 370737 | 7/1959 | Switzerland . |

OTHER PUBLICATIONS

D. Zickler, "Das Walzenschmelzverfahren", Textilterhnik 25, Nov. 1975.

*Primary Examiner*—Michael W. Ball
*Assistant Examiner*—Richard Crispino
*Attorney, Agent, or Firm*—Merchant, Gould, Smith, Edell, Welter & Schmidt, P.A.

[57] ABSTRACT

An apparatus for bonding, without adhesive, a plastic material layer onto a backing fabric of any kind, wherein the fabric is biaxially stretched and untreated, includes a calendar and a rocking device. The calendar includes a heated cylinder for coating the fabric with a layer of plastic material. The rocking device includes a preliminary heating element, a front end roll, and a rear end roll. The front end roll and rear end roll guide the stretched fabric onto the heated cylinder of the calendar to control the heating temperature of the stretched fabric in contact with the heated cylinder. The preliminary heating element is interposed between the front end roll and the rear end roll.

3 Claims, 2 Drawing Sheets

APPARATUS SUITABLE FOR PROVIDING DIRECTLY BY MEANS OF CALENDERING AN EXCELLENT ANCHORAGE BETWEEN A FABRIC AND ITS PLASTIC COATING MATERIAL

DESCRIPTION

The present invention relates to an apparatus suitable to provide a strong anchorage between a backing fabric and its coating, said coating consisting of a plastic material layer, by means of calendering, without the interposition of an adhesive layer.

For various industrial applications, fabrics of different kinds are required which are composed of natural, artificial or synthetic fibres, coated on at least one side with a layer of plastic material. While the fabric constitutes the strength-providing backing, the plastic material coating imparts properties of impermeability, hygiene, or resistance to chemicals of any kind.

For example, said coated fabrics can be used for the manufacture of conveyor belts for food or pharmaceutical industries, rubber boats, wet suits for scuba divers, life jackets or emergency slides for planes, water-proof tarpaulins for commercial vehicles, blowable safety cushions for cars (the so-called "airbags"), antistatic fabrics, artificial leather, table cloth with filted back-coating, flooring elements, and the like.

In order to realize a product of this kind, the adhesion between the backing fabric and the plastic material coating layer of the desired thickness must in any case satisfy certain breakaway resistance values in accordance with the final use of the product.

According to the present state of the art, satisfactory anchorage values can only be achieved with a complicated process wherein, before calendering, an adhesive primer has to be applied onto the fabric, said primer having been dissolved in suitable solvents, to a semiliquid state.

The necessary equipment for this treatment demands a considerable amount of space, implies additional working time, and requires a tunnel drying oven and a recovery plant for the flammable solvents to reduce fire hazard and air pollution, all of which is very expensive.

It is an object of the present invention to provide a relatively simple, on-line device for applying a plastic material coating onto a backing fabric, said device granting excellent anchorage characteristics allowing the use of already existing calendering means and avoiding the use of a primer as required by the prior art methods.

The backing upstream the device, is unwound, in known manner under adjustable tension, from a braked beam in order to stretch the fabric meshes lengthwise, and then passed onto a stave widening cylinder to widen the meshes, i.e. to attain a deformation in the orthogonal direction before arriving onto the heated coating cylinder of the calendar. The so biaxially stretched fabric is driven along the rocking device according to the invention and heated in a preheating station, then contacts with a heated coating cylinder of the calendar for a variable length depending on the needs, thereby adjusting the final heating time of the fabric on that cylinder according to the nature of the backing fabric. Said fabric, which has been heated to a suitable temperature according to its nature, receives a layer of plastic material from a pair of upper melting cylinders of the calender, said plastic mass being also subjected to a further heating between said coating cylinder and one of said upper melting cylinders to bring and keep it at a temperature close to the melting point in order to apply to said fabric a plastic material layer of desired thickness.

The so obtained layer of plastic material penetrates excellently the widened and heated meshes of the fabric, thereby providing a surprisingly strong adhesion that, from laboratory tests, has proved to be higher than that obtained with the prior art primer coating method, thus confirming the possiblity of eliminating said additional coating step which adds to the manufacturing costs and is not without drawbacks, and which demands bulky working stations.

The device according to the invention will be described in the following specification and can be fitted on-line to a conventional calender for fabric coating.

BRIEF DESCRIPTION OF THE DRAWINGS

In the figures, like parts are identified by like symbols.

With reference to FIG. 1, according to the known art, a backing fabric 10, coming from a feeding beam (not shown), passes through a preliminary treatment device, identified as A in the left corner of the figure, wherein it is subjected to a coating operation with an adhesive primer in a semiliquid form suited to the nature of the backing fabric and of the coating layer which can consist, e.g., of PVC (polyvinyl chloride), PU (polyurethane) or the like.

Figure 1:
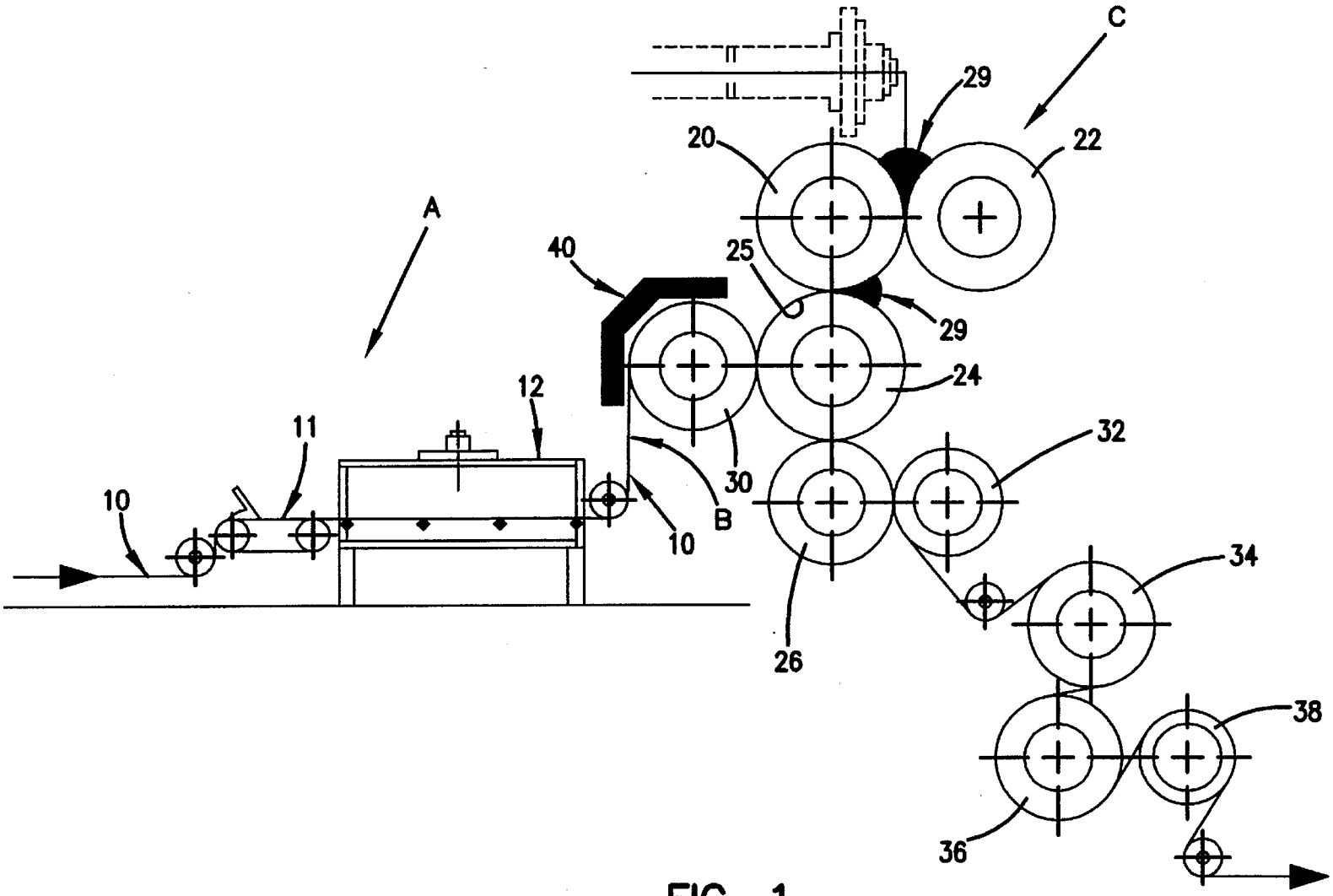
FIG. 1 (Prior Art)
FIG. 1 schematically shows the arrangement of a state of the art calendering plant for coating a backing fabric.

Device A implies therefore that the backing fabric 10 passes through a coating machine 11, followed by drying in an oven 12, and not to be overlooked, a plant (not shown) for the removal and recovery of the solvent, which plant is expensive and involves fire hazard and environmental pollution hazard.

In said state of the art process the fabric treated with the primer, identified as 10', can be separately collected in B, or it can be directly sent to calendering with the interposition of a suitable recovery festooner (also not shown), of known construction.

The primed fabric 10' is then coated in a calendering unit identified as C with a layer of variable thickness, depending on the needs, ranging of from 0.02 mm to 1 mm. The main cylinders 20, 22, 24, 26 and auxiliary cylinders 30, 32, 34, 36, 38 of said unit are shown schematically.

Cylinders 20, 22 and 24, implementing the heating and plastification step for the plastic material, are driven and heated, while driven cylinder 26 serves for detaching the coated fabric from cylinder 24.

The plastic material mass 29, which is preprocessed between cylinders 20 and 22 and further processed and gauged to the desired thickness between cylinders 20 and 24, forms, along arch 25 of the surface of cylinder 24, a layer that is applied and pressed onto fabric 10' by means of a pressing cylinder 30, which coated fabric 10' has been previously heated by means of an infrared device 40. Whereupon the fabric, coated with the plastic material layer on its primed side is detached from cylinder 24 by means of a rubber-coated cylinder 26 and can be embossed, if so required, by means of an embossing cylinder 32. The fabric is made to advance by the driven cylinder 38, through the idle cooling cylinders 34 and 36, and it is finally wound-up.

Figure 2:
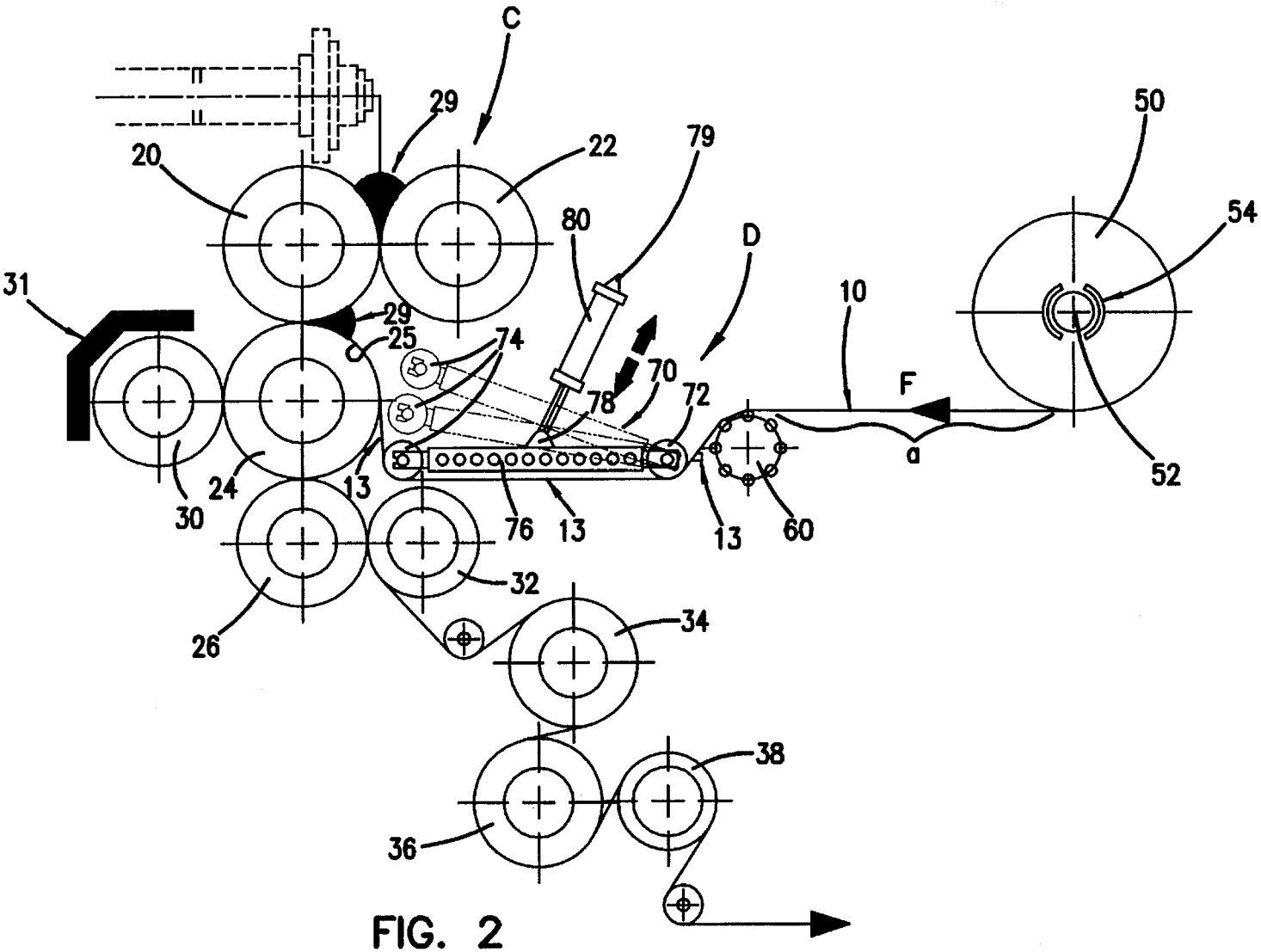
FIG. 2 schematically shows the arrangement of a calendaring plant for the same purpose provided with a device according to the invention.

FIG. 2 schematically shows one of the possible positions where the rocking apparatus 70 according to the invention can be fitted onto the framework of a calendering unit as conventionally used in industry and illustrated in FIG. 1, thereby allowing to eliminate the burdensome priming step.

The untreated fabric is inwound from a beam 50 mounted on an axle 52 provided with an adjustable brake 54.

Along its path, in the direction shown by arrow F, the untreated, backing fabric 10 is subjected in a known manner to a first stretching in the zone A of its meshes in the lengthwise direction, said stretching being proportional to the pulling force imparted by the adjustable braking action of brake 54; it then passes over a widening cylinder 60, for example of the kind with elastic staves, which effects a transversal stretching of the backing fabric 10, thereby causing a widening of the meshes in the orthogonal direction. The backing fabric with biaxially stretched meshes, identified as 13, is driven along the rocking device 70 having a heating device according to the invention provided with 76, a front and rear end, freely rotating, rolls 72 and 74 respectively, which guide said fabric 13 close to the surface of said heating device.

The rocking device 70 is pivoted on the same axis as the freely rotating front end roll 72, so that the rear end roll 74 can take up various positions that, as shown in the figure, are concentric with the axis of said roll 72. According to these positions, so varies the tangent point in which backing fabric 13, stretched biaxially and preheated, touches the coating cylinder 24, thereby attaining a longer or shorter dwelling time proportional to the total length of arch 25', during which the fabric remains on the heated coating cylinder 24 in order to precisely set the temperature, according to the nature of the fabric 13, at which said fabric 13 enters beween cylinders 20 and 24 of calendar C. The position of rear end roll 74 is adjusted by means of a hydraulic piston 80 pivoted at a point 78 on the frame of the rocking device 70 and, at the opposite end, on the fixed frame of the calender at point 79.

The heated fabric 13 is coated, as it passes between cylinders 20 and 24, with a layer of the desired thickness of plastic material fed in a semimolten state, as shown in FIG. 1, between the upper melting cylinders 20 and 22 and between said cylinders 20 and 24. Maintaining the plastic material in this physical state during contact with the backing fabric is a decisive condition because the plastic material can best penetrate the widened meshes of the heated fabric 13, in the semimolten state, which state can be maintained thanks to the heating of the fabric, thereby providing an excellent adhesion and penetration even without a primer. The so coated fabric, passed between cylinders 20 and 24 of the calendering unit C, is pressed in known manner between cylinders 24 and 30, the latter cylinder also being heated, for example by means of an infrared device 31, whereafter the processing follows along the conventional steps already described in relation to FIG. 1 as for a primed fabric.

This process implemented with the inventive device 70 is much more economical than the prior art process due to the fact that the cumbersome, expensive and also dangerous priming step has been eliminated.

The relative apparatus, by means of which said inventive process is carried out, can easily be fitted onto the conventional calendering units already being used by those performing this type of process.

The device described and illustrated is suitable for any kind of backing fabric by selecting case by case the appropriate preheating temperature provided by heating device 76 and the stay time on cylinder.

The preferred arrangement of the inventive device as described and illustrated in FIG. 2, can obviously be modified according to, e.g. the type and position of calender C, on the understanding that the scope of protection covers all the constructive solutions which allow to achieve the same object exploiting the same inventive idea.

In particular, the rocking device 70 with its heating device 76 can be variously positioned about cylinder 24 using driving means different from hydraulic piston 80, or it can be displaced by a movement different from rocking through any known means.

I claim:

1. An apparatus for coating without adhesive a plastic material layer onto a backing fabric of any kind, wherein the fabric is biaxially stretched and untreated, the apparatus comprising:

a calendar having a heated cylinder for coating the fabric with a layer of plastic material; and a rocking device having a frame and including, a preliminary heating element;

a front end roll and a rear end roll, both on the frame, to guide the stretched fabric onto the heated cylinder of the calendar to control the dwell time of the stretched fabric in contact with the heated cylinder; and the preliminary heating element being interposed between said front end roll and said rear end roll.

2. An apparatus according to claim 1 wherein the rocking device is pivoted on a same axle on which the front end roll rotates the rear end roll being at an end of the rocking device opposite of the front end roll and being capable of taking up various vertical positions, said positions being concentrical with the axis of said front end roll, in order to vary a first contact point of fabric with the heated cylinder whereon the fabric is coated with the layer of plastic material, and consequently varying dwelling time of said fabric on said heated cylinder, thus controlling the final temperature of the fabric.

3. An apparatus according to claim 2 wherein the rocking device is rotated through an angle by means of a hydraulic piston, a first end of which is pivoted at an intermediate point of the frame of the rocking device, a second end opposite of the first end being pivoted at a fixed position of a frame of the calendar, in order to adjust the position of the rear end roll of the device in relation to an optimal contact point of the fabric with the heated cylinder.

* * * * *